US006371811B1

(12) United States Patent
Chen et al.

(10) Patent No.: US 6,371,811 B1
(45) Date of Patent: Apr. 16, 2002

(54) VERTICAL-TYPE UNIVERSAL SERIAL BUS CONNECTOR HAVING A LOW PROFILE ON A PRINTED CIRCUIT BOARD

(75) Inventors: Qiang Chen; GuangXing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/803,484

(22) Filed: Mar. 8, 2001

(30) Foreign Application Priority Data

Oct. 20, 2000 (TW) ..... 89218235

(51) Int. Cl.[7] ..... H01R 13/648
(52) U.S. Cl. ..... 439/607; 439/79
(58) Field of Search ..... 439/607, 608, 439/609, 79, 541.5, 676

(56) References Cited

U.S. PATENT DOCUMENTS 6,210,235 B1 * 4/2001 Wu ..... 439/607
6,213,813 B1 * 4/2001 Huang ..... 439/607
6,224,422 B1 * 5/2001 Zhu et al. ..... 439/607
6,238,241 B1 * 5/2001 Zhu et al. ..... 439/79

* cited by examiner

*Primary Examiner*—Hien Vu
(74) *Attorney, Agent, or Firm*—Wei Te Chung

(57) ABSTRACT

A vertical-type USB connector (100) comprises a dielectric housing (1) having a base (11) and a mating board (12), a plurality of terminals (4) retained within the housing, a stopping plate (3) mounted to the housing for preventing the terminals from rearward movement, and two metallic shells (21, 22) enclosing the housing. Each contact comprises a mating section (41), a base section (422) received in the base, a lever section (424) sandwiched between a rear surface (13) of the base and the stopping plate, and a soldering tail (45). The connector is mounted on a printed circuit board (5) in a manner that a flange (126) of the mating board abutting against a front edge (53) of the printed circuit board and the base abutting against a top surface (51) of the printed circuit board.

6 Claims, 6 Drawing Sheets

VERTICAL-TYPE UNIVERSAL SERIAL BUS CONNECTOR HAVING A LOW PROFILE ON A PRINTED CIRCUIT BOARD

BACKGROUND OF THE INVENTION

1. Field of the Invention

The present invention relates to an electrical connector, and particularly to a vertical-type universal serial bus connector.

2. Brief Description of the Related Art

A conventional vertical-type universal serial bus (USB) connector 7 is disclosed in Taiwan Patent Application No. 85217217 as shown in FIG. 6. The connector 7 comprises a dielectric housing 8, four contacts 9 to be received in the housing 8, and a metallic shell 80 for enclosing the housing 8. The housing 8 defines four vertically aligned receiving passageways 82 for receiving corresponding contacts 9 therein. Each contact 9 has a contacting section 91, a securing section 92, and a soldering tail 93.

When the connector 7 is mounted on a printed circuit board (hereafter, PCB), a total height of the connector is located above the PCB. As the vertical-type USB connector has a high profile, when the height of the connector is totally above the PCB, the connector 7 is not stable, particularly when the connector 7 is subject to a mating force. Furthermore, the high profile configuration is unfavorable in view of the trend of minimization. Moreover, the securing sections 92 of lower two contacts 9 are bent three times from the contacting sections 91 for even distribution of the soldering tails 93. The triply curved securing sections 92 make manufacturing of the contacts time-consuming and cost-plus. In addition, each securing section 92 forms a pair of barbs 921 for biting into the housing 8 to prevent the contact 9 from rearward movement during mating with a complementary connector (not shown). Since the barbs 921 are tiny and likely to be destroyed, the contacts 9 will possibly be pushed rearwardly from the passageways 82.

Hence, an improved vertical-type USB connector is required to overcome the disadvantages of the prior art.

BRIEF SUMMARY OF THE INVENTION

A first object of the present invention is to provide a vertical-type USB connector having a lower profile above a printed circuit board on which the connector is mounted.

A second object of the present invention is to provide a vertical-type USB connector having a plurality of terminals which are easily fabricated and are reliably secured to a housing of the connector.

An electrical connector in accordance with the present invention comprises a dielectric housing, a plurality of terminals retained within the housing, a dielectric stopping plate, and two metallic shells enclosing the housing therein.

The housing comprises a base and a mating board forwardly extending from the base. The mating board forms a flange located beneath a mounting surface of the base. The base defines a plurality of vertically aligned passageways.

Each terminal includes a mating section, a securing section continuing from the mating section, and a soldering tail depending from the securing section. Each securing section has a base section fitted within the corresponding passageway, and a lever section bent from the base section. The lever section and the soldering tails abut against a rear surface of the base and are sandwiched between the base and the stopping plate secured to the base, for preventing the terminals from moving rearwardly from the passageways.

The connector is mounted on a printed circuit board in a manner that the mounting surface of the base engaging with a top surface of the printed circuit board and the flange of the mating board abutting against a front edge of the printed circuit board, thereby reducing a overall dimension of the connector above the printed circuit board.

Other objects, advantages and novel features of the invention will become more apparent from the following detailed description when taken in conjunction with the accompanying drawings.

DETAILED DESCRIPTION OF THE EMBODIMENT

Figure 1:
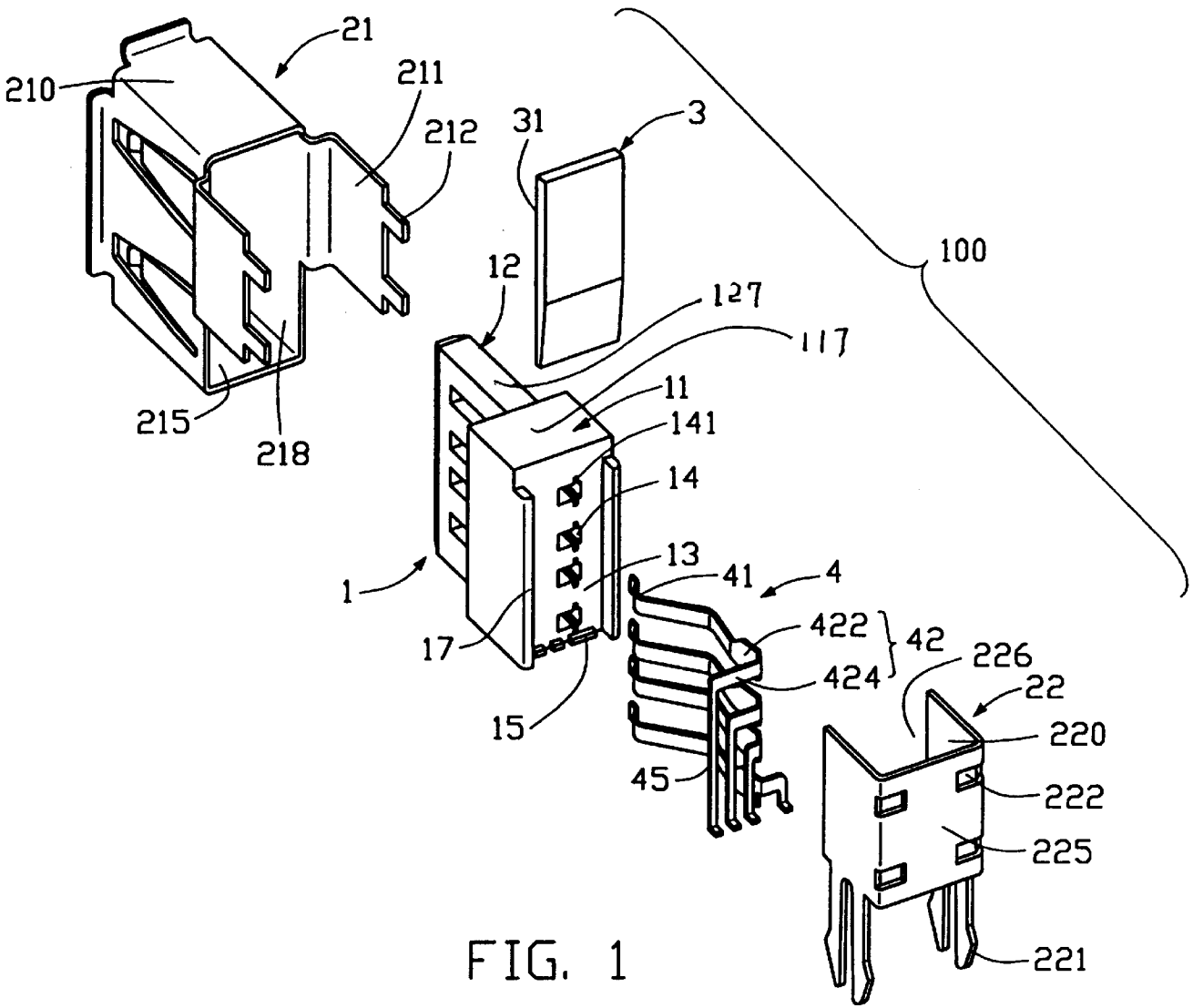
FIG. 1 is an exploded view of a vertical-type USB connector in accordance with the present invention.
Figure 2:
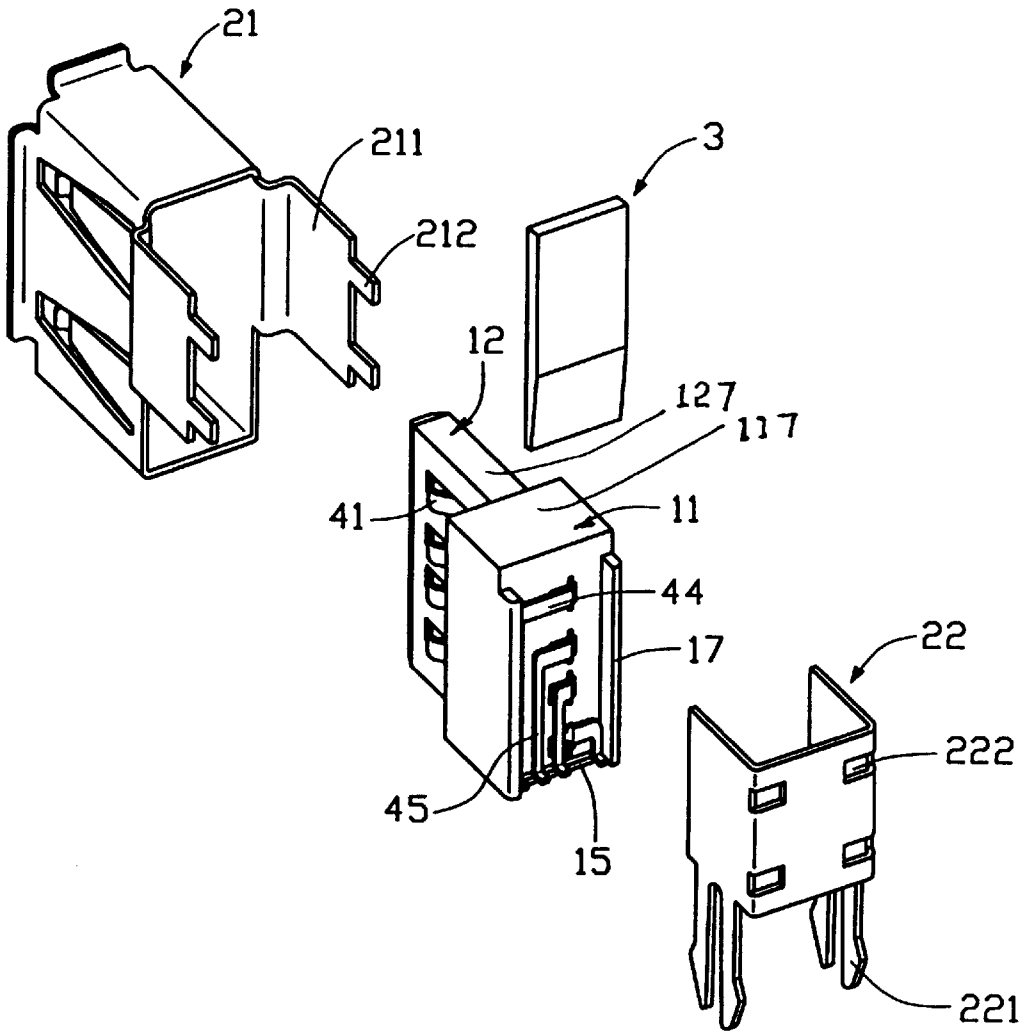
FIG. 2 is similar to FIG. 1, showing terminals mounted to a housing of the connector of FIG. 1.

Referring to FIGS. 1 and 2, a vertical-type USB connector 100 in accordance with the present invention comprises a dielectric housing 1, a plurality of terminals 4 for being retained within the housing 1, a dielectric stopping plate 3 with a flat abutting surface 31, a metallic first shell 21, and a metallic second shell 22 for enclosing the housing 1, the terminals 4, and the stopping plate 3 therein.

The housing 1 comprises a base 11 and a mating board 12 extending forwardly from the base 11. A flange 126 of the mating board 12 is located below a bottom mounting surface 110 of the base 11 (see FIG. 3). In this embodiment, the mating board 12 is downward offset from the base 11 under the condition that the upper face 127 of the mating board 12 is below the upper face 117 of the base 11, and the lower face 129 of the mating board 12 is below the lower face, i.e., the bottom mounting surface 110, of the base 11. The base 11 has a rear surface 13 on which a pair of ribs 17 is formed at lateral sides thereof and a plurality of projections 15 is formed at a lower edge thereof. A plurality of vertically aligned passageways 14 extends through the base 11 into the mating board 12. The base 11 defines a pair of recesses 141 recessed from the rear surface 13 of the base 11. The recesses 141 are located beside each passageway 14 along the vertical direction and are communicated with the passageway 14.

Each terminal 4 comprises a curved mating section 41 for engaging with a contact of a mating connector (not shown), a securing section 42, and a soldering tail 45 extending downwardly from the securing section 42. Each securing section 42 includes a flat base section 422 rearwardly continuing from the mating section 41, and a lever section 424 perpendicularly, leftward bent from the base section 422. However, the lever section 424 of the lowest terminal 4 is bent right for maximizing a distance between soldering portions of the lower two terminals 4. Each securing section 42 is subjected to bending merely once.

The first shell 21 has an enclosed peripheral wall 210. A pair of embracing arms 211 extends rearwardly from an upper portion of two lateral sides of the peripheral wall 210. A first receiving space 218 is boarded by the peripheral wall 210. A lower wall 215 of the peripheral wall 210 is located beneath the embracing arms 211. Further, a pair of stubs 212 extends rearwardly from each embracing arm 211. The second shell 22 includes a pair of sidewalls 220 and a rear wall 225 connecting with the sidewalls 220. The walls 220, 225 together define a second receiving space 226 therebetween. A pair of boardlocks 221 depends from the sidewalls 220, respectively. The rear wall 225 defines a pair of windows 222 in each of two lateral sides thereof.

Figure 3:
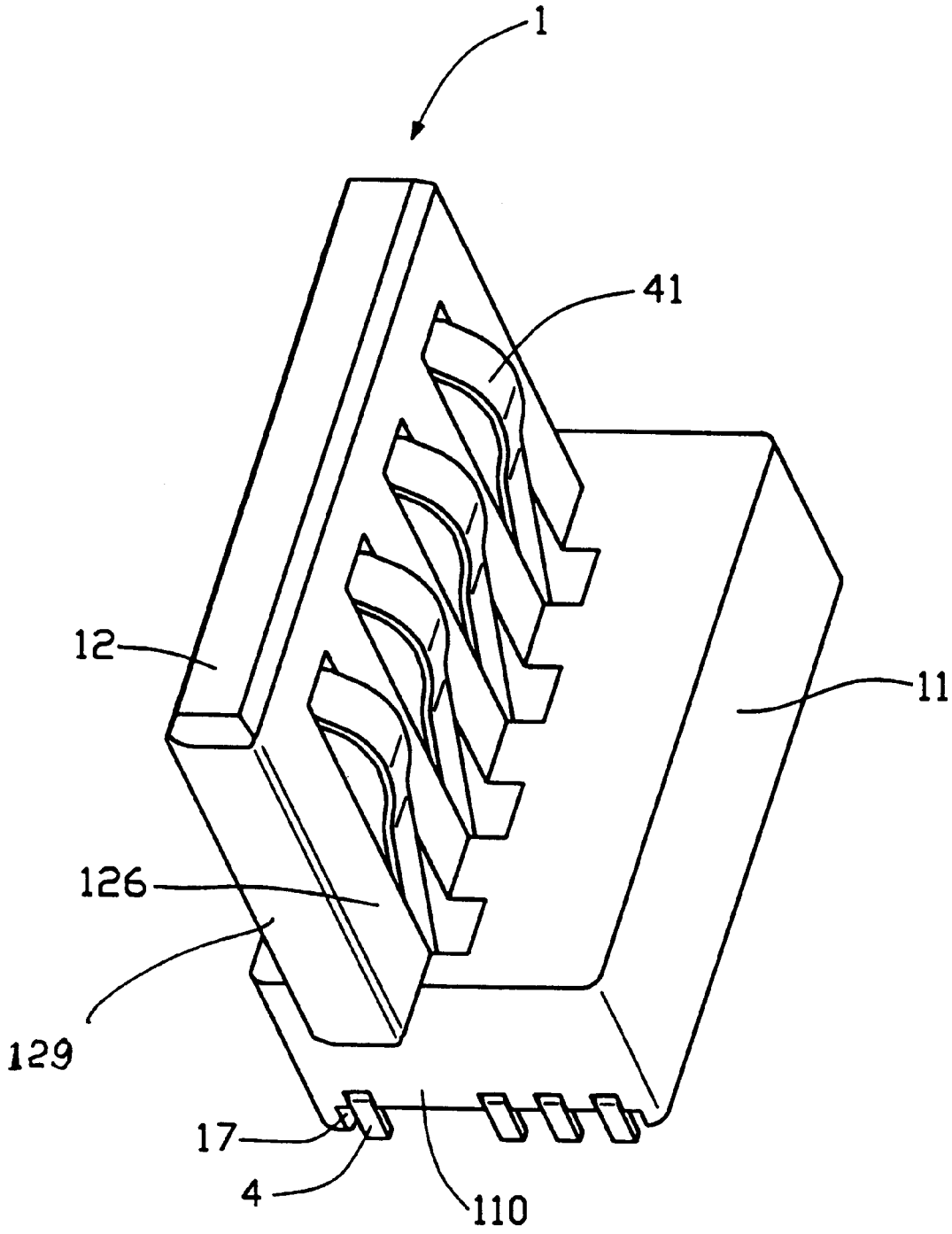
FIG. 3 is an enlarged view of the assembly of the terminals and the housing of FIG. 2, as viewed from a front side of the housing.
Figure 4:
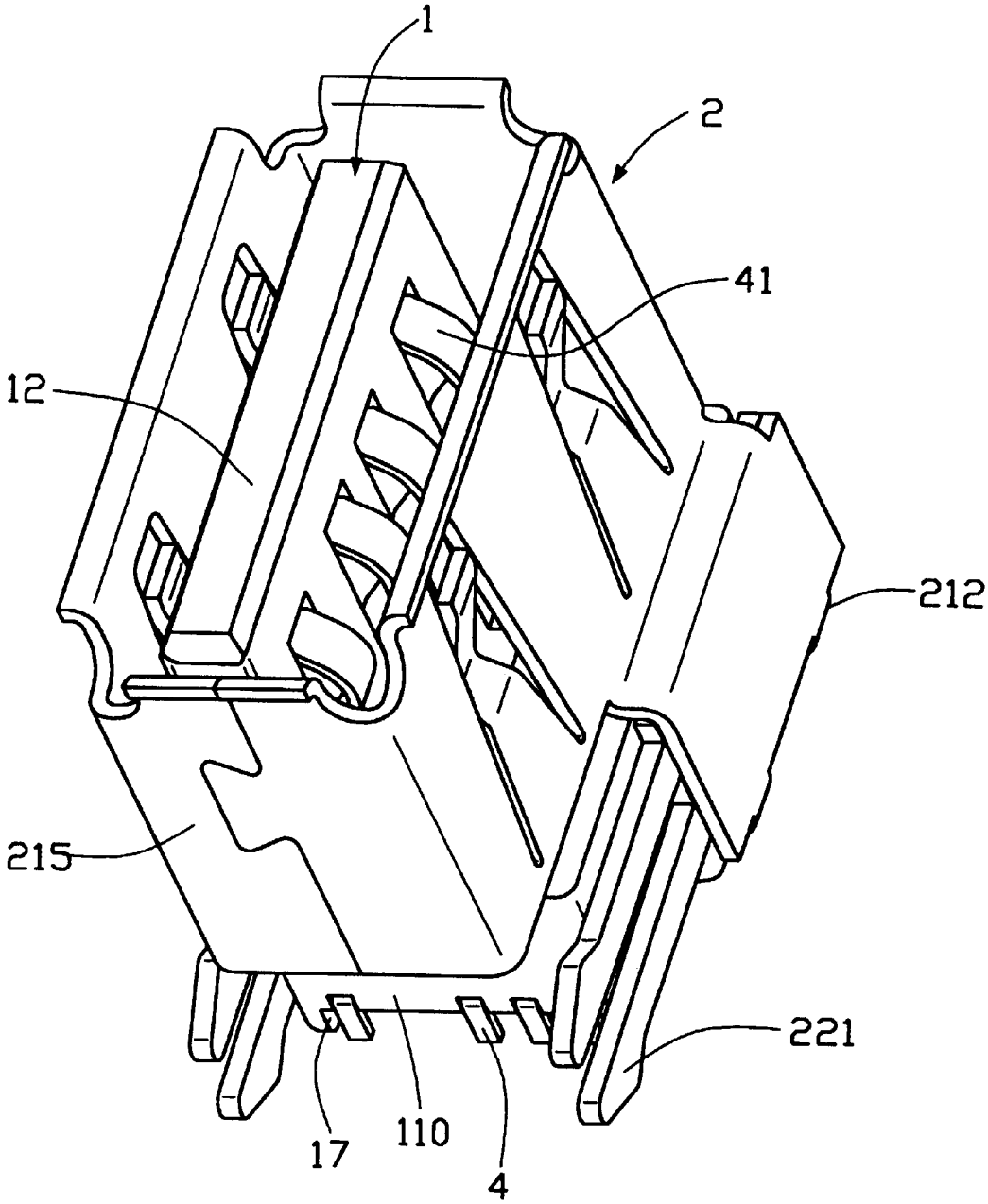
FIG. 4 is an assembled view of FIG. 1.

Referring to FIGS. 2–4, in assembly, the terminals 4 are received in the passageways 14 such that the mating sections 41 are received in the passageways 14 in the mating board 12, the base sections 42 are snuggly fitted within the recesses 141 while the lever sections 424 and the soldering tails 45 abut against the rear surface 13 of the base 11. The soldering tails 45 have surface mount sections 451 which are positioned between the projections 15 and spaced from each other for properly surface mounting to electrical traces of a printed circuit board (PCB) 5 (see FIG. 5).

The stopping plate 3 has a wedged lower portion 32. The stopping plate 3 is fixedly attached to the rear surface 13 of the base 11 by the ribs 17 which clamp the stopping plate 3 therebetween when the stopping plate 3 is inserted into a space defined between the ribs 17 and the rear surface 13 of the base 11. After the stopping plate 3 is assembled to the base 11, the lever sections 424 and the soldering tails 45 are sandwiched between the base 11 and the stopping plate 3 and are tightly pressed against the rear surface 13 by the flat abutting surface 31 of the stopping plate 3. The stopping plate 3 presses the lever sections 424 and the soldering tails 45 of the terminals 4 against the rear surface 13. This prevents the terminals 4 from rearward movement when the complementary connector is engaged with the connector 100.

Finally, the first and second shells 21 and 22 are assembled to the housing 1 with the terminals 4 and the stopping plate 3 by the following means. The housing 1 together with the terminals 4 are first assembled with the second shell 22 by inserting an upper portion of the base 11 into the second receiving space 226. The sidewalls 220 of the second shell 22 securely clamp side surfaces of the base 11 and the rear wall 225 abuts against the stopping plate 3. Then the first shell 21 is mounted to the housing 1 together with the second shell 22 to a position where the mating board 12 is received in the first receiving space 218 and the sidewalls 220 are located between the embracing arms 211. Finally, the stubs 212 are bent into the windows 222 to grip with the second shell 22 so that the vertical-type USB connector 100 in accordance with the present invention is obtained.

Figure 5:
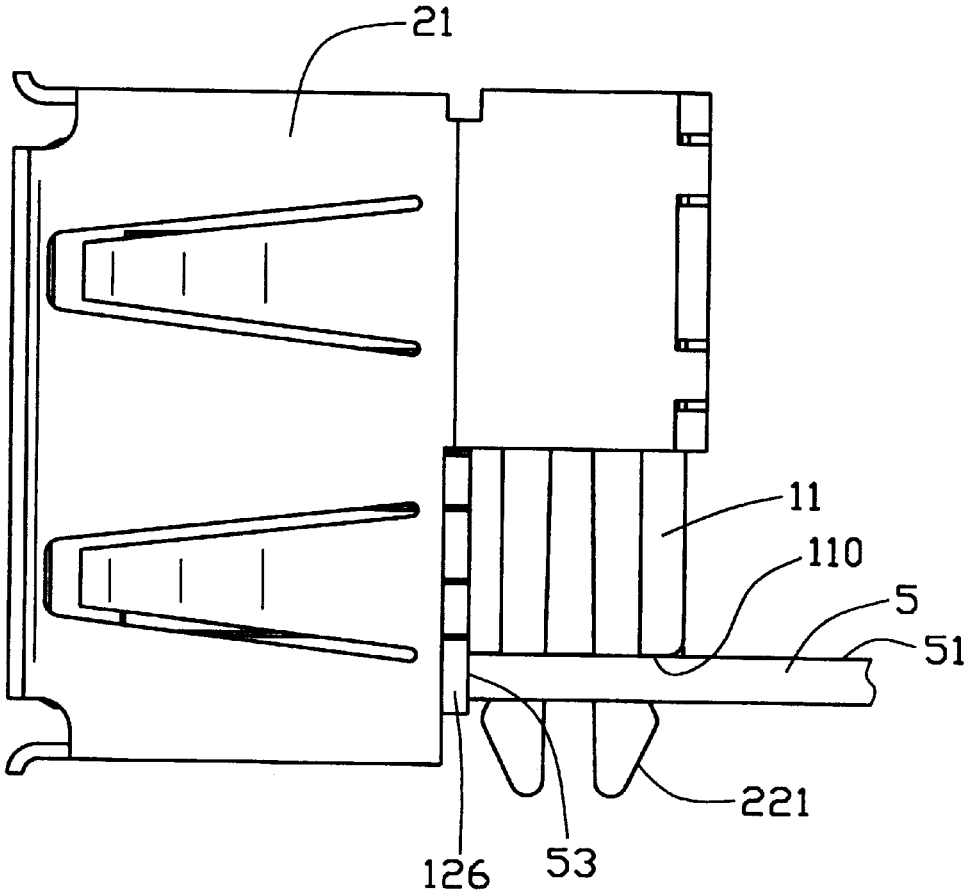
FIG. 5 is a side view of FIG. 4, showing the connector mounted on a printed circuit board.
Figure 6:
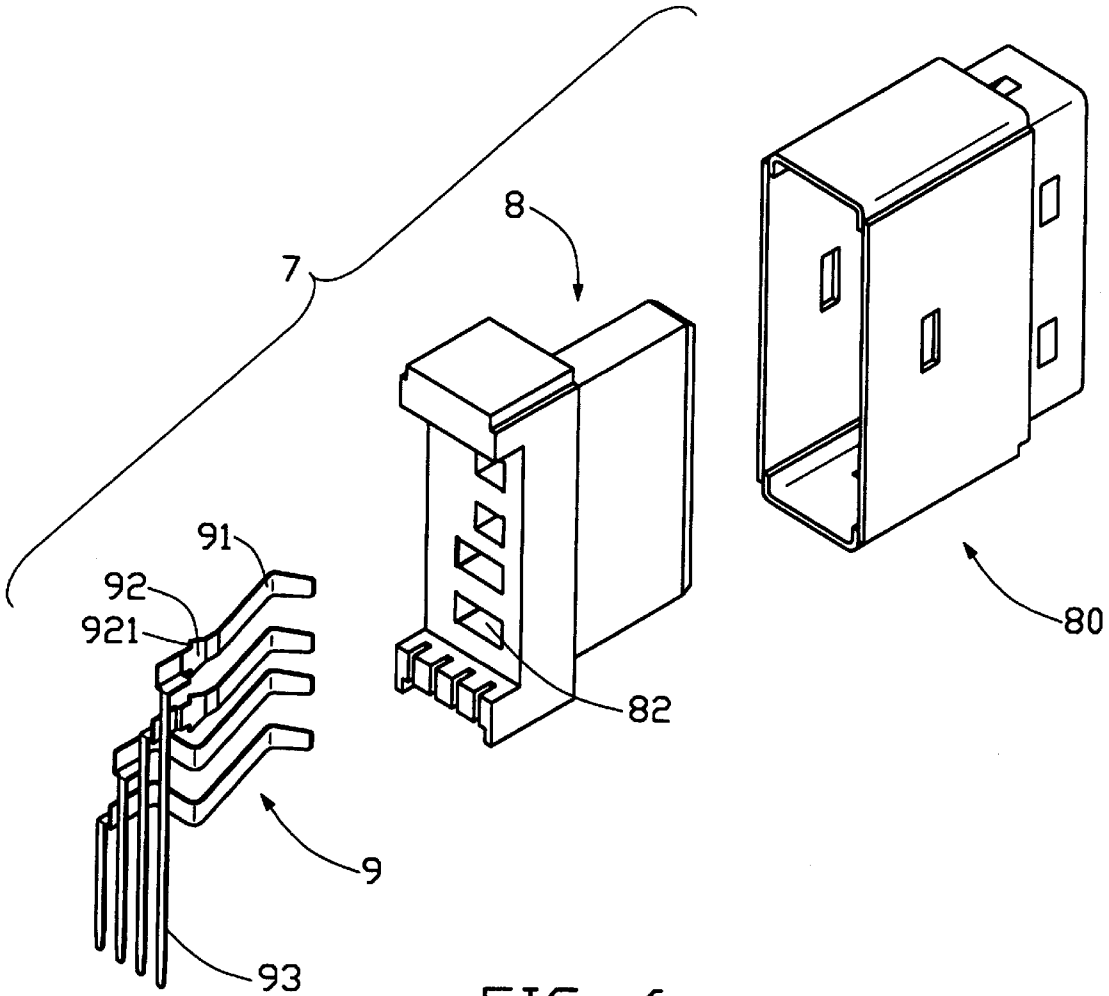
FIG. 6 (PRIOR ART)
FIG. 6 is an exploded view of a conventional vertical-type USB connector.

In use, particularly referring to FIGS. 4 and 5, the connector 100 is mounted to the PCB 5 in a position wherein the mounting surface 110 of the base 11 engages with a top surface 51 of the PCB 5 and a rear surface of the flange 126 of the mating board 12 abuts against a front edge 53 of the PCB 5 so that a lower portion of the connector 100 including the lower wall 215 is located beneath the PCB 5. Accordingly, a height of the connector 100 above the PCB 5 is less than the overall height of the connector 100. The boardlocks 221 extend through and engage with the PCB 5 to firmly mount the connector 100 on the PCB 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of a vertical-type USB connector and a printed circuit board, comprising:

a dielectric housing including a base with a mounting surface at a lower side and a mating board projecting forwardly from the base, the mating board having a flange located below the mounting surface, the housing defining a plurality of vertically arranged passageways extending from a rear surface of the base into the mating board, and forming a pair of ribs at lateral sides of the rear surface;

a plurality of conductive terminals each including a mating section for electrical connection with a contact of a complementary connector, said mating section being received in the passageways in the mating board, a base section extending from the mating section and fitted in the passageways in the base, a lever section bent from the base section and abutting the rear surface of the base, and a soldering tail depending from the lever section and also abutting against the rear surface;

a dielectric stopping plate snugly received between the ribs and abutting the lever section and the soldering tails for fixing the terminals in the passageways;

a first metal shell having a peripheral wall receiving the mating board and a pair of embracing arms extending rearwardly from the peripheral wall, the embracing arms respectively forming at least one rearwardly extending stub; and a second metal shell having a second receiving space receiving the base, a pair of sidewalls grasping lateral sides of the base and being located between the embracing arms, and a rear wall defining a plurality of windows receiving the stubs of the embracing arms, the second shell forming a pair of boardlocks for mounting on the printed circuit board; wherein the mounting surface abuts against a top surface of the printed circuit board and a rear surface of the flange of the mating board abuts against a front edge of the printed circuit board; wherein the peripheral wall of the first shell has a lower wall positioned below the printed circuit board; wherein the stopping plate has a wedged lower section.

2. The combination as claimed in claim 1, wherein the base defines a plurality of recesses recessed from the rear surface, located beside each of the passageways along the vertical direction and communicating with the passageways.

3. The combination as claimed in claim 2, wherein the base sections are fitted into the recesses.

4. The combination as claimed in claim 3, wherein the lever section of the lowest terminal extends in a direction opposite from that the lever sections of other terminals extend.

5. The combination as claimed in claim 3, wherein the stopping plate presses the lever section and the soldering tails against the rear surface.

6. The combination as claimed in claim 1, wherein a plurality of projections are formed on a lower edge of the rear surface, the soldering tails being positioned between the projections and spaced from each other.

* * * * *